US007377066B2

(12) United States Patent
Moore

(10) Patent No.: US 7,377,066 B2
(45) Date of Patent: May 27, 2008

(54) FIREARM WITH A READILY INTERCHANGEABLE BOLT FACE

(76) Inventor: Wildey J. Moore, 45 Angevine Rd., Warren, CT (US) 06794

( * ) Notice: Subject to any disclaimer, the term of this patent is extended or adjusted under 35 U.S.C. 154(b) by 483 days.

(21) Appl. No.: 10/527,841

(22) PCT Filed: Sep. 26, 2003

(86) PCT No.: PCT/US03/30471

§ 371 (c)(1),
(2), (4) Date: Mar. 15, 2005

(87) PCT Pub. No.: WO2004/033982

PCT Pub. Date: Apr. 22, 2004

(65) Prior Publication Data

US 2006/0037464 A1 Feb. 23, 2006

Related U.S. Application Data

(60) Provisional application No. 60/417,522, filed on Oct. 9, 2002.

(51) Int. Cl.
*F41A 15/12* (2006.01)

(52) U.S. Cl. ..... 42/25

(58) Field of Classification Search ..... 42/25
See application file for complete search history.

(56) References Cited

U.S. PATENT DOCUMENTS

| | | | | |
|---|---|---|---|---|
| 3,728,939 | A | 4/1973 | Wilhelm | |
| 3,996,684 | A | 12/1976 | Bauman et al. | |
| 4,615,132 | A * | 10/1986 | Smith | 42/25 |
| 4,617,749 | A | 10/1986 | Jurek | |
| 4,920,677 | A * | 5/1990 | Schuerman | 42/16 |
| 4,942,802 | A | 7/1990 | Stoner | |
| 6,732,465 | B2 * | 5/2004 | Strayer | 42/69.03 |

* cited by examiner

*Primary Examiner*—Stephen M Johnson
(74) *Attorney, Agent, or Firm*—McCormick, Paulding & Huber LLP

(57) ABSTRACT

A readily replaceable bolt face for a firearm (10) with a movable slide (12) that strips a round from a magazine, extracts the spent round from the firing chamber and then ejects the round from the firearm by means of an ejector. A bolt face insert (32) has an external configuration that is common to a range of calibers, but with a bolt face side (66) designed to fit the rim of a specific caliber or calibers having the same rim dimension. The insert may be replaced to fit a different caliber without replacing the slide. The bolt face insert is provided with a slot (62) for the ejector and a groove (60) to accept an extractor for the specified caliber.

5 Claims, 3 Drawing Sheets

FIREARM WITH A READILY INTERCHANGEABLE BOLT FACE

CROSS REFERENCE TO RELATED APPLICATIONS

This application claims the benefits of prior filed, co-pending U.S. provisional patent application Ser. No. 60/417,522 filed on Oct. 9, 2002 and International Application No. PCT/US2003/030471 filed on Sep. 26, 2003.

TECHNICAL FIELD

This invention relates to an improved construction for a firearm, particularly a hand held repeater of semi-automatic or automatic design. More particularly, it relates to an improved construction for a firearm of the type having a longitudinally movable slide on the frame with a bolt face that feeds cartridges from a magazine and ejects spent casings.

BACKGROUND ART

Hand held repeaters are known in the prior art of a semi-automatic or automatic design, having a bolt or movable slide that strips a round from a magazine. The slide or bolt is driven to the rear from its battery position upon firing, extracting the spent round from the firing chamber, which is then ejected from the firearm by means of an ejector. The bolt face or slide face is engineered to encapsulate the base or rim of a specific round, determined by the diameter of the rim for safety and function purposes.

This invention relates in general to the construction of firearms and, in particular, to the construction of the bolt or slide area called the face. Typically, this face area is manufactured as an integral part of the bolt or slide, restricting the use of these major components to a specific caliber or calibers having the same rim dimension. Other components frequently can be used in the manufacture of firearms of the same basic type, the difference being the caliber, magazine capacity, sighting arrangements or other features where the same slide or bolt could be used except for their being restricted to a specific caliber by the bolt or slide face area.

The invention takes into the account the high cost of manufacturing the slide or bolt as a component, the need to decrease inventory cost where other components are utilized in the production of a variety of firearms and the inventory of slides needs to be kept high to accommodate the varying demands, the need of militaries to inventory a variety of caliber firearms for special purposes, the cost of replacing firearms with new ones, should a new caliber be desired as a replacement and the desire of an end user to be able to change calibers for different shooting applications.

Accordingly, one object of the present invention is to provide a simplified firearm construction having a readily interchangeable bolt face.

Another object of the invention is to provide a simplified construction for an interchangeable bolt face insert.

Another object of the invention is to provide an improved firearm construction which reduces the cost of the spare parts inventory.

Another object of the invention is to provide an improved firearm, whose slide or bolt may readily be converted to use a different caliber cartridge.

DISCLOSURE OF INVENTION

Briefly stated, the invention uses a slide with the area normally associated with the face removed from this component and a recess cut into the slide for the insertion of an independent part referred to as an interchangeable bolt face insert. The bolt face insert is designed so that its outside dimension is common to the area removed from the slide for its insertion. Its inside dimension however, is manufactured to accommodate a specific cartridge base or rim dimension and cut to accept an extractor (its retainer) of the proper length, to extract the cartridge that it is designed to encapsulate. By inserting the proper interchangeable bolt face and extractor, the slide now becomes versatile to the use of a wide variety of cartridges. In the case of a firearm utilizing a slide, one need only install a barrel of the desired caliber with its compatible interchangeable bolt face, the proper extractor and a magazine to shoot a specific caliber. Barrels are required to have the same outside dimensions, caliber-to-caliber, to mate with their working surfaces in the slide. In the case of a firearm not utilizing a slide, but a movable bolt, the same method of insertion and retention are utilized.

The invention is practiced by providing an improved bolt face for a firearm of the type having a frame, a barrel having a bore adapted to receive a cartridge of a selectable caliber disposed in the frame, a slide or bolt arranged to move longitudinally between a forward and a rearward position with respect to the frame and the barrel, the slide or bolt defining a breechblock portion having a longitudinal hole therethrough and a longitudinally spaced ejection chamber, a firing pin longitudinally slidable in the longitudinal hole to enable it to strike the cartridge when the slide or bolt is in the forward position, an extractor adapted to match the selected caliber of the cartridge, and an ejector fixed to the frame and extending into the ejection chamber when the slide is in a rearward position, characterized in that the breechblock portion defines a semi-circular groove, a bolt face insert comprising a body having central hole and a semi-circular rim adapted to removably fit into the semi-circular groove, the insert body having a breechblock side facing the frame breechblock portion and having an oppositely disposed bolt face side facing the extraction chamber when the semi-circular rim is inserted into the semi-circular breechblock groove, the insert bolt face side being adapted to match the selected caliber of the cartridge. In its preferred form the bolt face insert defines an extractor groove adapted to receive the extractor, and the insert also defines a longitudinal ejector slot adapted to receive the ejector.

BRIEF DESCRIPTION OF DRAWINGS

The invention will be better understood by reference to the following description, taken in connection with the accompanying drawings, in which.

BEST MODE OF CARRYING OUT THE INVENTION

Figure 1:
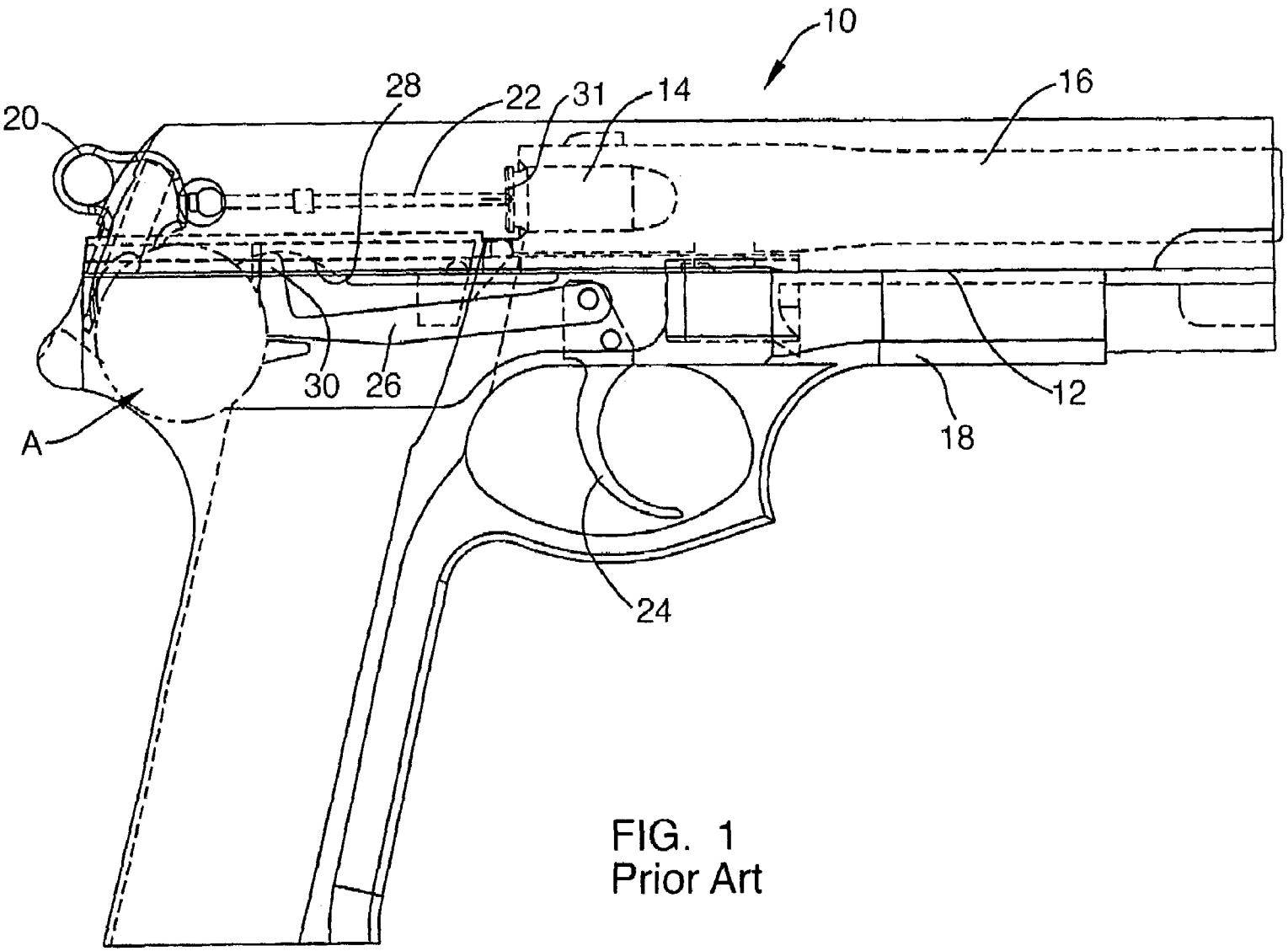
FIG. 1 Prior Art
FIG. 1 is a side elevational drawing, partly in section, of portions of a semi-automatic firearm, according to the prior art.

Referring now to FIG. 1 of the drawing, the prior art is described as embodied in a semi-automatic firearm 10 of the type using a spring-loaded cartridge magazine (not shown) and having a reciprocating slide 12 adapted to move from a forward position in a rearward direction against a recoil spring (not shown) when a cartridge 14 is fired. During the rearward movement, the shell of cartridge 14 is ejected, and during the return forward movement, a new cartridge is stripped from the magazine by the extractor and inserted into the bore of a barrel 16 in a manner well known in the art. Slide 12 is reciprocable in tracks upon a frame 18. A hammer 20 is pivotably mounted on frame 18 to strike a firing pin 22, which is longitudinally slidable in the slide 12 so as to strike the rear of cartridge 14. A trigger 24 is pivotably mounted in the frame and connected to push or pull a transfer bar 26. Slide 12 includes a cam surface 28, which cooperates with a finger 30 to raise or lower the end of transfer bar 26 and release the hammer, when the transfer bar is pushed or pulled longitudinally by the trigger 24.

The firearm of FIG. 1 is shown with the slide 12 in a forward position, with hammer 20 un-cocked. A bolt face 31 formed in the end of a solid breechblock portion of the slide is adjacent and receives the rear of cartridge 14. An extractor (not shown) is engaged over the back end of the cartridge casing ready to cooperate with an ejector (not shown) in a manner well known in the art to remove the casing from the barrel bore and eject the casing through an opening in the slide during movement to the rearward position of the slide.

The invention is an improvement in a construction for a semi-automatic hand held repeater known in the prior art. It is important to note that the bolt face 31 of a prior art slide is an integral part of the slide and dimensioned for a particular caliber. Converting to a different caliber would require a different slide for the firearm.

Figure 2:
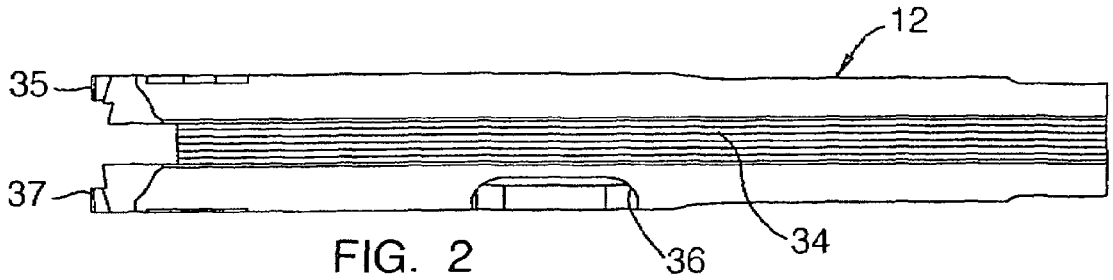
FIG. 2 is a top plan view of the firearm of FIG. 1, modified according to the present invention.

Referring to FIGS. 2-6 of the drawings, a slide 12 according to the present invention is shown. FIG. 2 shows a top view of the slide with sighting ridges 34 and an ejection port 36. Indicated on the rear end of the slide are grooved flanges 35, 37, which receive mating flanges on the frame 12 to hold the slide and guide it in a longitudinal direction on the frame.

Figure 3:
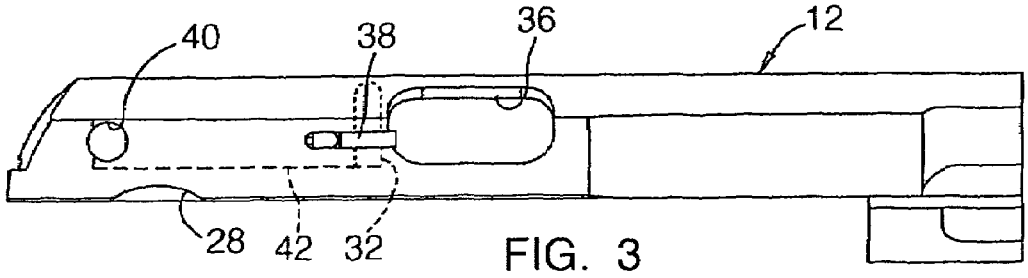
FIG. 3 is a side elevational view of the slide of FIG. 2.

FIG. 3 is a side view of the slide indicating ejection port 36, an extractor 38 and a safety pin 40. A separate bolt face insert, to be later described in detail, is shown in dashed lines and indicated by reference number 32.

Figure 4:
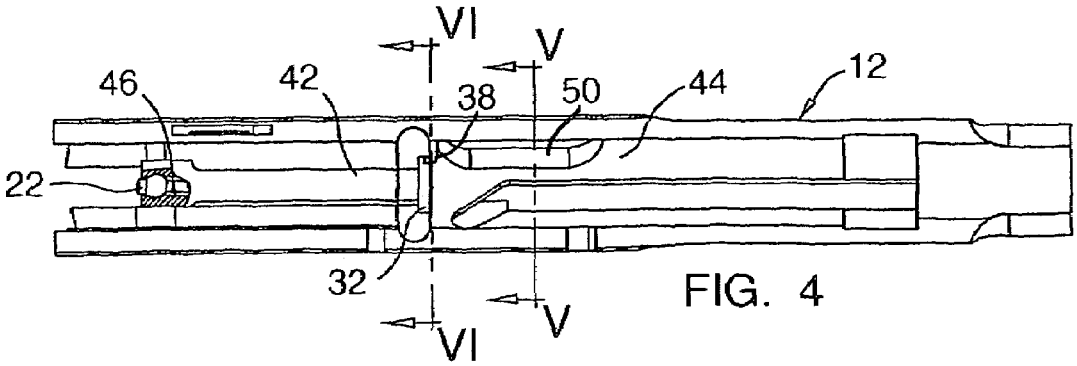
FIG. 4 is a bottom plan view of the slide of FIG. 2.

FIG. 4 is a bottom plan view of the slide 12. The slide includes a solid breechblock portion 42 and a longitudinally disposed extraction chamber 44. A longitudinal hole 46 extends through the solid breechblock portion 42 to accommodate a sliding firing pin 22.

Referring to FIG. S of the drawing, taken along section V - V an extractor is shown at 38 as well as the ejection port 36 and portions 50 of a cartridge magazine holding a cartridge 14. Beyond the cartridge 14 the bolt face insert 32 is seen disposed in the slide 12 and held in place by extractor 38.

Figure 6:
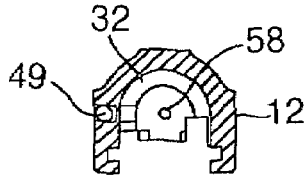
FIG. 6 is a cross-sectional view of the slide, looking in the direction of arrows VI-VI of FIG. 4.
Figure 9:
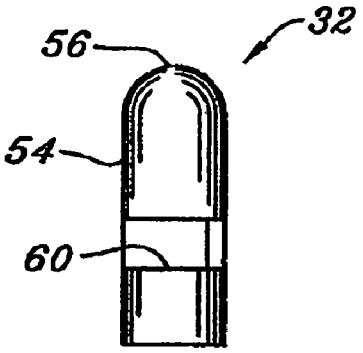
FIG. 9 is a side elevational view of the bolt face insert.
Figure 8:
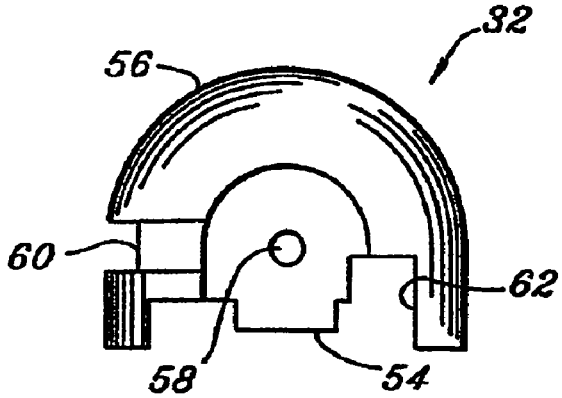
FIG. 8 is a front elevational view of the bolt face insert.
Figure 7:
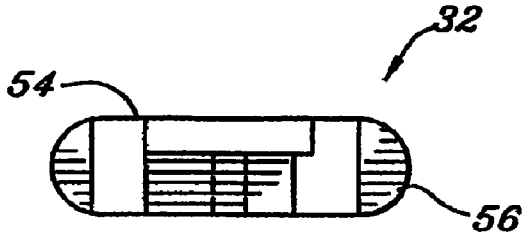
FIG. 7 is a bottom plan view of a bolt face insert according to the present invention.

Referring to FIG. 6 of the drawing, taken along section VI- VI, bolt face insert 32 is shown disposed in the slide 12. The extractor is removed from the view to reveal an extractor recess with spring well at 49.

Referring now to FIGS. 7-11, various views of the bolt face insert according to the present invention are shown. The bolt face insert, shown generally at 32 has a body 54 with a semi-circular rim 56 and a central hole 58, both coaxial with an axis 59. Central hole 58 is located so as to be aligned with the hole 46 in the breechblock portion 42 when the bolt face insert is disposed in the slide.

Figure 5:
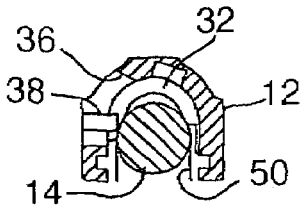
FIG. 5 is a cross-sectional view of the slide, looking in the direction of arrows V-V of FIG. 4.
Figure 10:
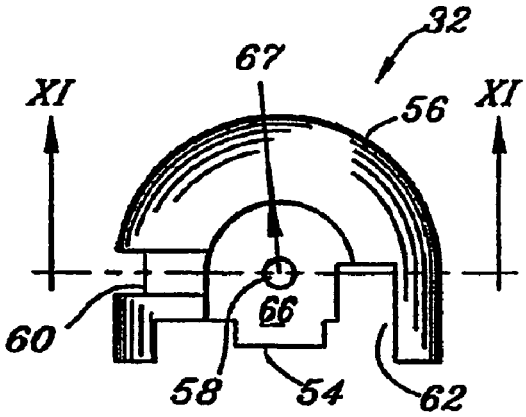
FIG. 10 is a front elevational view of the bolt face insert similar to FIG. 8.

In accordance with one aspect of the present invention, the bolt face insert 32 is provided with an extractor groove 60 cut through the rim 56 extending perpendicular to axis 59 and adapted to receive an extractor (FIG. 5). The bolt face insert 32 is further provided with a longitudinal ejector slot 62 through the body extending parallel to axis 59 and adapted to receive the ejector (not shown). The ejector is fixed to the frame so that it will pass through ejector slot 62 when the slide moves, and eject the casing through ejection port 36. As indicated in the cross-section of FIG. 11, the bolt face insert 32 has a breechblock side 64 and a bolt face side 66. The bolt face side 66 is especially configured to receive the rim of a specific caliber cartridge, for example by properly dimensioning the bolt face side with the proper diameter 67 as seen in FIG. 10.

Figure 12:
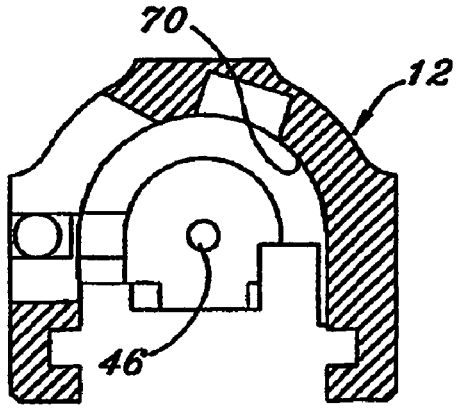
FIG. 12 is a front elevational view in cross-section of a slide modified to accept the bolt face insert.
Figure 11:
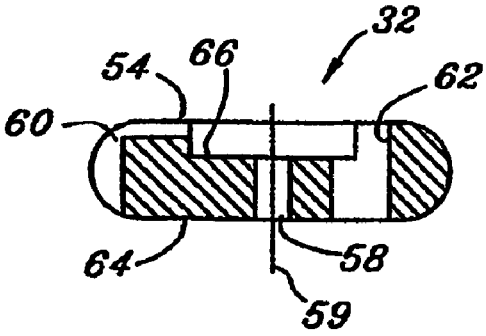
FIG. 11 is a top view in cross-section taken along lines A-A of FIG. 10.

Referring to FIG. 12 of the drawing, a cross-section is indicated of the firearm slide 12. In almost every respect, slide 12 is like a prior art slide, except that it is modified to include a semi-circular groove 70 which is cut into the end of the slide 12 adjacent the end of solid breechblock portion 42 (see FIG. 4). Groove 70 is preferably cut coaxial with the central hole 46 in the breechblock and is of the proper dimension to receive the semi-circular rim 56 of the bolt face insert, so that breechblock hole 46 will line up with insert hole 58.

According to the present invention, the exterior dimensions of the semi-circular rim of the bolt face insert are always the same, whereas the bolt face side 66 of the insert 32 is configured according to a selected caliber size. Therefore it is only necessary to substitute one bolt face insert for another, and to substitute a different extractor, magazine and barrel in order to change the caliber of the firearm.

While there has been described what is considered to be the preferred embodiment of the invention, other modifications will occur to those skilled in the art. It is desired to secure all such modifications as fall within the true spirit and scope of the invention.

The invention claimed is:

1. An improved bolt face for a firearm of the type having a frame defining a longitudinally extending extraction chamber, a barrel having a bore adapted to receive a cartridge of a selected caliber disposed in the frame, a slide or bolt arranged to move longitudinally between a forward and a rearward position with respect to said frame and said barrel, said slide or bolt defining a breechblock portion having a longitudinal hole therethrough, a firing pin longitudinally slidable in said longitudinal hole to enable it to strike the cartridge when the slide or bolt is in the forward position, an extractor adapted to match the selected caliber of the cartridge, and an ejector fixed to the frame and extending into said extraction chamber, wherein said breechblock portion defines a semi-circular groove coaxial with said longitudinal hole and further defines an extractor recess, said firearm having a bolt face insert comprising a body defining a semi-circular rim adapted to removably fit into said semi-circular groove, said extractor disposed in said extractor recess and arranged to retain said bolt face insert, said body having a breechblock side facing said breechblock portion and having an oppositely disposed bolt face side facing the extraction chamber when the insert rim is inserted into the breechblock groove, and said bolt face side of said body adapted to match the selected caliber of said cartridge.

2. The combination according to claim 1, wherein said bolt face insert further defines a longitudinal ejector slot located and dimensioned to receive said ejector when said slide or bolt moves to said rearward position.

3. The combination according to claim 1, wherein said bolt face insert further defines an extractor groove adapted to receive said extractor.

4. The combination according to claim 1, wherein said bolt face insert further defines a central hole therethrough located in the body so as to be aligned with said longitudinal hole in said breechblock portion when the insert rim is inserted into the semi-circular groove.

5. The combination according to claim 1, wherein said bolt face insert comprises said body having a longitudinal axis and defining said semi circular rim disposed about said axis, said body defining a hole therethrough along said axis, said bolt face insert defining a longitudinal ejector slot through said body extending parallel to said axis, and said bolt face insert further defining an extractor groove through said semi-circular rim extending perpendicular to said axis.

* * * * *